United States Patent [19]

Shepherd

[11] Patent Number: 4,903,553

[45] Date of Patent: Feb. 27, 1990

[54] DRESSING APPARATUS FOR GRINDING WHEELS

[76] Inventor: James E. Shepherd, 1231 Dutton Rd., Eagle Point, Oreg. 97524

[21] Appl. No.: 338,846

[22] Filed: Apr. 17, 1989

[51] Int. Cl.[4] ..... B23D 63/00; B24B 53/02

[52] U.S. Cl. ..... 76/37; 51/5 D

[58] Field of Search ..... 76/25 A, 37, 40, 41, 76/42, 43; 51/5 D

[56] References Cited

U.S. PATENT DOCUMENTS 2,986,048 5/1961 Nielsen ..... 76/37

3,779,103 12/1973 Silvey ..... 76/25

*Primary Examiner*—Roscoe V. Parker

*Attorney, Agent, or Firm*—Eugene M. Eckelman

[57] ABSTRACT

A pair of grinding wheel dressing tools are mounted on a common support slidably mounted in a base secured in a fixed position adjacent a grinding wheel. The support has adjustment for repositioning it as the grinding wheel wears and requires dressing. The adjustment for the support maintains the pair of wheel dressers in their selected dressing planes as adjusted positioning between the wheel dressers and the grinding wheel occurs.

7 Claims, 3 Drawing Sheets

DRESSING APPARATUS FOR GRINDING WHEELS

BACKGROUND OF THE INVENTION

This invention relates to new and useful improvements in grinding wheel dressing means and is particularly applicable to dressing means for saw chain grinding wheels.

A saw chain extensively in use employs chisel bit type cutter elements. These cutter elements have angled cutting surfaces that are ground by a grinding wheel properly shaped so as to have a pair of grinding surfaces extending in top and edge tapered planes. The most efficient angle of the cutting surfaces of a saw chain is predetermined and to maintain such efficiency, these angles must remain constant as the wheel wears to a smaller diameter. If the wheel is dressed too thin, the side plate of the tooth will be ground too thin which does not leave clearance for the wood chips to be removed whereby the chain will bind in the cut. If the wheel is dressed too thick, the side plate of the tooth will be ground out too much and does not leave the portion of the tooth, namely, the gullet, that holds the tooth upright and keeps it from trying to lay over in the cut. The gullet guides the tooth through the wood.

Grinding wheel dressing means now in use employ individually operable dressing heads for individually dressing each of the grinding surfaces of the wheel. Without a scale for a guide, dressing is accomplished by eye, or in other words, what looks right. If too much dressing occurs on the top surface, the edge surface becomes too thin and then it is required that the top surface be redressed for correct thickness. Likewise, if too much dressing occurs on the edge surface, the wheel at the top surface becomes too thick and thus the top surface has to be redressed to thin it back down. Such of course is wasteful of the grinding wheel surfaces.

SUMMARY OF THE INVENTION

According to the present invention and forming a primary objective thereof, dressing apparatus for a grinding wheel is provided that maintains a consistent shape to the grinding wheel surfaces as the wheel is dressed and reduced in size.

A more particular object is to provide dressing apparatus for a grinding wheel that employs a pair of grinding wheel dresser means both mounted on a single adjustable support whereby said pair of dresser means are maintained in their selected dressing planes as said adjustable support is adjusted for wheel wear.

In carrying out the objectives of the invention, base means are employed which are arranged to be secured in a fixed position adjacent to a grinding wheel of the type having a pair of grinding surfaces extending in different planes, such as a saw chain grinding wheel. A pair of grinding wheel dresser means are mounted on a single support in turn mounted on the base means. Adjustment means between the support and the base means are provided which are arranged to reposition the pair of wheel dresser means relative to the grinding wheel as the latter wears and requires dressing. The adjustment means maintains the pair of wheel dresser means in their selected dressing planes as adjusting positioning between the wheel dresser means and the grinding wheel occurs. The support also includes means arranged to initially position or reset the dressing planes of the grinding wheel dresser means.

The invention will be better understood and additional objects and advantages will become apparent from the following description taken in connection with the accompanying drawings.

DETAILED DESCRIPTION OF A PREFERRED EMBODIMENT

Figure 1:
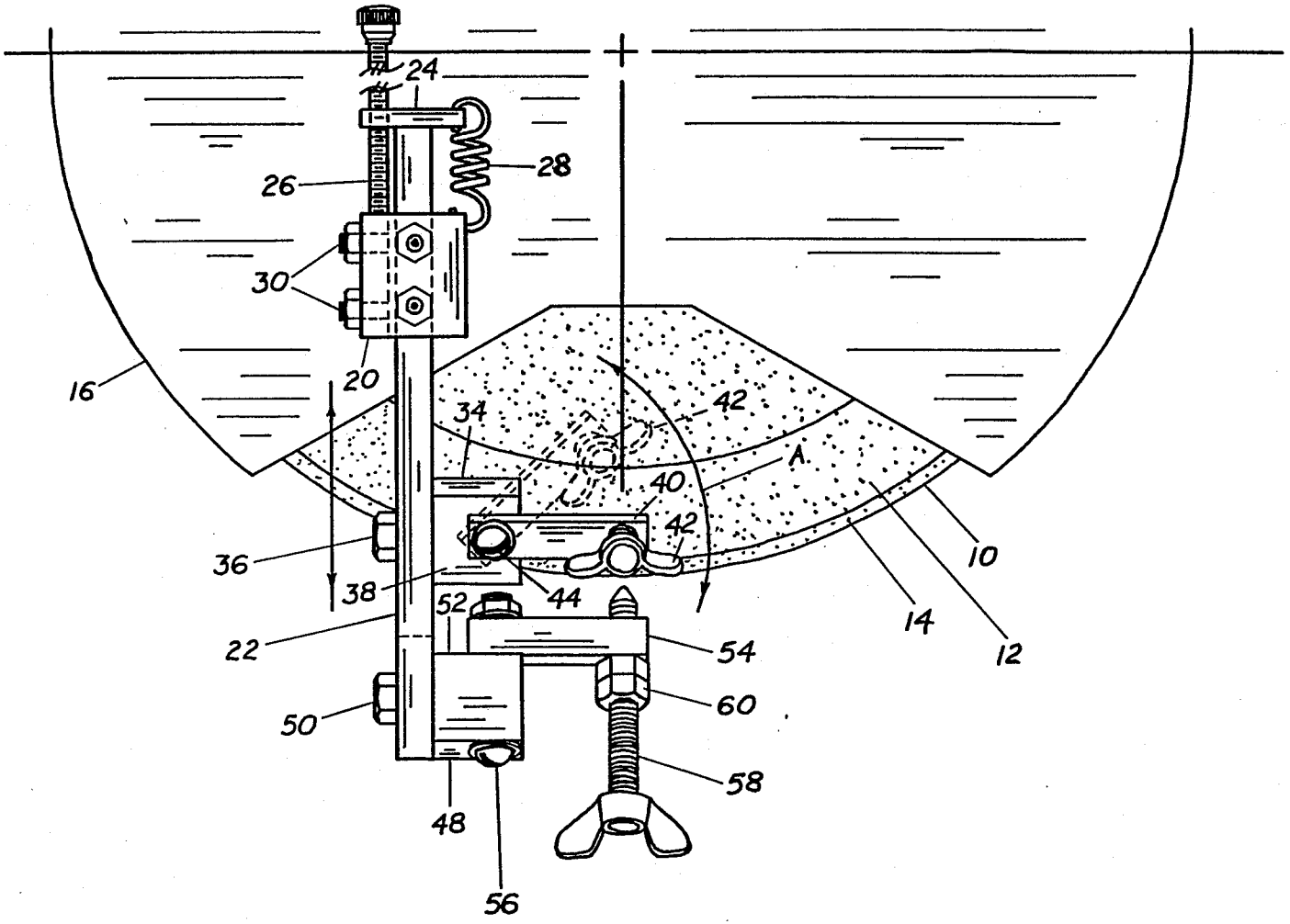
FIG. 1 is a top plan view of the dressing apparatus of the present invention.
Figure 2:
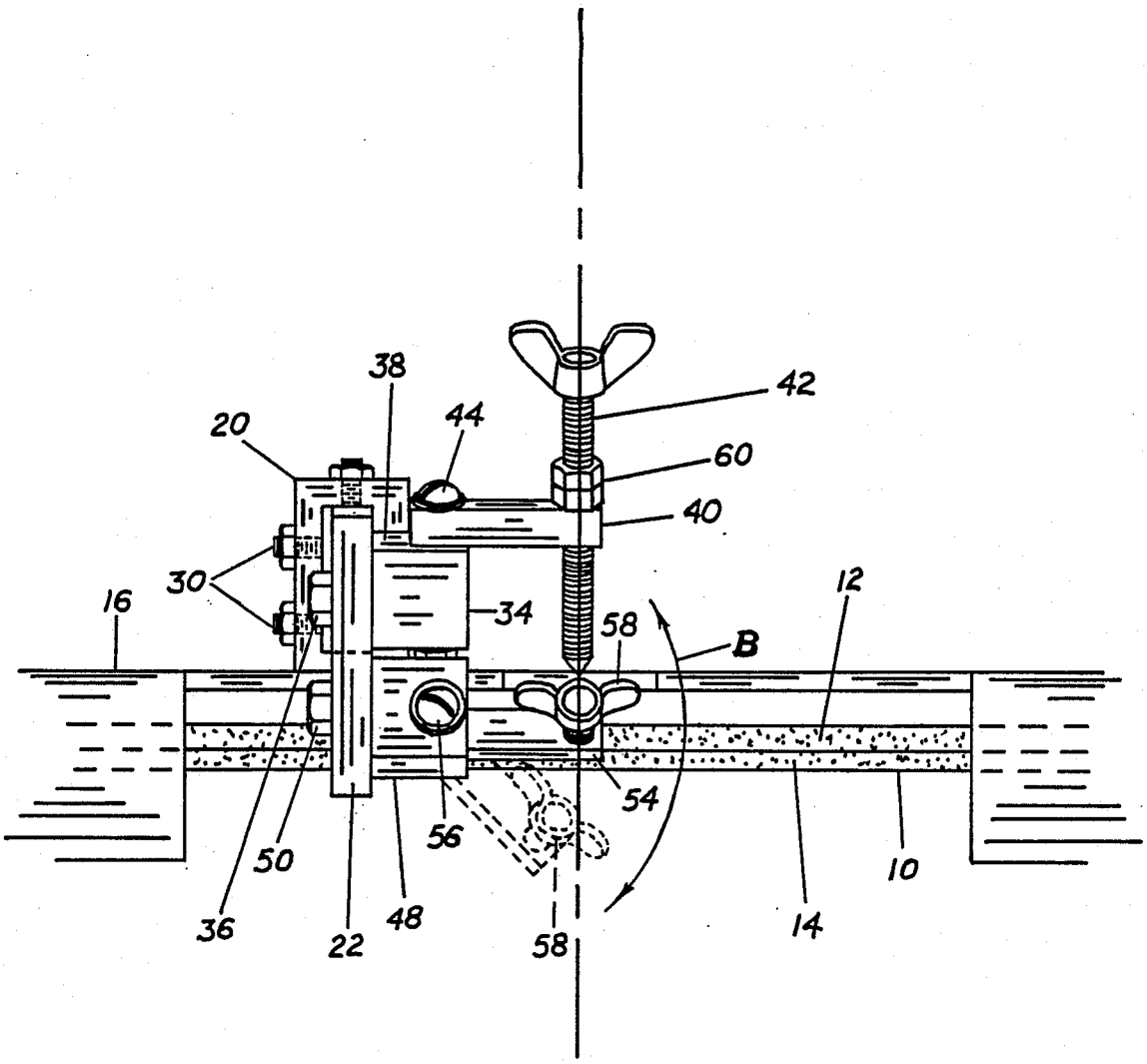
FIG. 2 is a front elevational view of the dressing apparatus.
Figure 3:
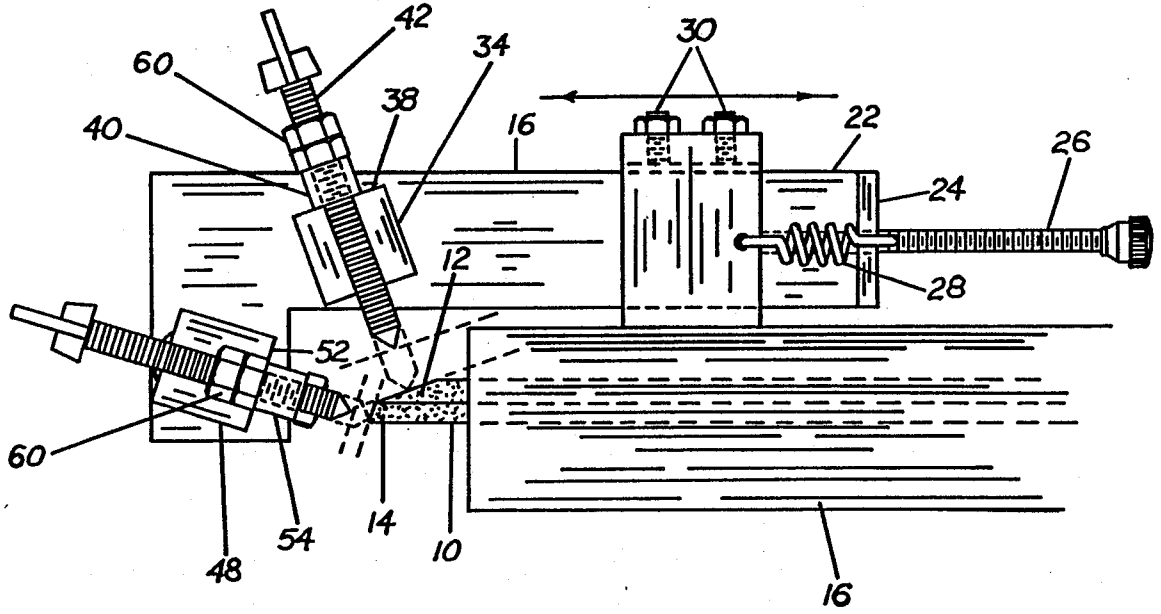
FIG. 3 is a side elevational view.

The present dressing apparatus is particularly applicable to the dressing of a saw chain grinding wheel 10, FIGS. 1, 2 and 3. This type of grinding wheel is disc-like in shape and has a pair of saw chain sharpening surfaces 12 and 14 adjacent its outer edge. Surface 12 comprises a tapered top surface and surface 14 comprises a tapered edge surface, and the combination of these two surfaces of the shape shown particularly in FIG. 3 provide proper sharpening of the chisel bit type cutter elements of saw chains. As stated hereinbefore, maintaining the precise ground relationship of these two surfaces as the wheel wears and is redressed is important. Grinding wheel 10 in conventional structure is associated with a support housing 16 suitably mounted on a pedestal or other base, not shown, of conventional construction.

According to the invention, a base portion 20 therefor is securely anchored, as by welding, to the support housing 16 for the grinding wheel. Base portion 20 preferably is mounted on the top of the grinding wheel housing 16. Base portion 20 is offset to one side of the longitudinal center of the grinding wheel and supports a slide arm 22 for longitudinal movement. The rearward end of slide arm 22 has a flange 24 that threadedly supports a longitudinally disposed adjusting screw 26 having its forward end abutted against the base portion 20. The slide arm 22 is urged forwardly for abutment of the adjusting screw 26 against the base portion 20 by a tension spring 28 connected between the flange 24 and the base portion.

Slide arm 22 is maintained in a fixed but adjustable position by cooperating interaction of the adjusting screw 26 and tension spring 28. Slack adjusting screws 30 may be employed in the base portion 20 to remove any unwanted slack in the slidable support of the slide arm.

One side surface of the slide arm 22 supports a first laterally projecting block 34 by means of a single horizontal axis mounting bolt 36. Block 34 has a top surface 38 which forms a pivotal guide surface for a laterally projecting dressing arm 40 having a threadedly mounted diamond dressing tool 42 supported at right angles thereon. Dressing arm 40 has a pivot support 44 at its inner end on the top surface 38 of block 34, such pivotal mounting and support of the arm 40 on the surface 38 allowing swinging dressing movement of the tool 42 between full and broken line positions shown in FIG. 1 and indicated by arrow A, as will be more fully explained hereinafter.

A second block 48 is mounted on the slide arm 22, also by means of a single, horizontal axis mounting bolt 50. The lower surface 52 of block 48 provides a pivotal guide surface for a second dressing arm 54 held pivotally against this surface by a pivot member 56. Dressing arm 54 threadedly supports a dressing tool 58 at right angles therein and has swinging dressing movement between full and broken line positions shown in FIG. 2 and indicated by arrow B. This dressing tool as well as dressing tool 42 are adjustable axially by the threaded support thereof in their respective dressing arms. The dressing tools are releasably locked in position by lock nuts 60.

As apparent in the drawings, the dressing tools 42 and 58 provide dressing for the two grinding wheel surfaces 12 and 14. They operate through a swinging arc with their arms 40 and 54, respectively, approximately at the front center of the wheel. The blocks 34 and 48 are clamped into position by their respective mounting bolts 36 and 50 such that the arm supporting surfaces 38 and 52 are parallel with the negative surfaces 12 and 14 of the wheel for a dressing operation now to be described.

For setting the dressing apparatus up for a wheel, it is assumed that the angular disposition of the two wheel surfaces 12 and 14 is known. With these two known factors, the blocks 34 and 52 are properly angled on the slide arm 22 by clamped engagement of their mounting bolts 36 and 50, respectively, in an arrangement such that the swing arm guide surfaces 38 and 52 are parallel with the respective surfaces 12 and 14. Adjustment of the slide arm 22 and of the dressing tools are accomplished by threaded operation of the adjusting screw 26. When a proper position is made for the tools at the edge of the grinding wheel, the tools are swung with their arms around the pivots 44 and 56 to accomplish the dressing operation. As the wheel wears, adjusting screw 26 is threaded inwardly to retract the slide arm 22 for wheel wear. Since the two dressing arms are mounted as a unit on a single adjusting slide arm 22, a consistent grinding wheel shape will be maintained every time that the wheel is dressed. This then provides efficient grinding of a chisel bit type saw chain.

It is to be understood that the form of my invention herein shown and described is to be taken as a preferred example of the same and that various changes in the shape, size and arrangement of parts may be resorted to without departing from the spirit of my invention, or the scope of the subjoined claims.

Having thus described my invention, I claim:

1. Dressing apparatus for a grinding wheel of the disc-type having a peripheral portion including a pair of grinding surfaces extending in different planes, said apparatus comprising:

base means arranged to be secured in a fixed position adjacent the grinding wheel, a pair of grinding wheel dresser means, support means mounting said wheel dresser means on said base means in selected planes of operation for simultaneously dressing the respective grinding surfaces, and adjustment means arranged to reposition said pair of wheel dresser means relative to the grinding wheel as the latter wears and requires dressing, said adjustment means maintaining said pair of wheel dressing means in their selected dressing planes as adjusting positioning between said wheel dresser means and the grinding wheel occurs.

2. Dressing apparatus for a saw chain grinding wheel having a disc-shaped body member with a pair of grinding surfaces extending in different planes for grinding a pair of beveled surfaces of a chisel bit type cutter element, said apparatus comprising:

base means arranged to be secured in a fixed position adjacent the grinding wheel, a pair of grinding wheel dresser means, support means mounting said wheel dresser means on said base means in selected planes of operation for simultaneously dressing the respective cutter element grinding surfaces, and adjustment means arranged to reposition said pair of wheel dresser means relative to the grinding wheel as the latter wears and requires dressing, said adjustment means maintaining said pair of wheel dresser means in their selected dressing planes as adjusting positioning between said wheel dresser means and the grinding wheel occurs, whereby to maintain a consistent grinding wheel shape as the wheel is dressed and thus to maintain consistent sharpening of chain saw cutter elements.

3. The dressing apparatus of claim 2 wherein said support means mounts said wheel dresser means for dressing movement along the full width of their respective grinding surfaces.

4. The dressing apparatus of claim 2 wherein said support means mounts said wheel dresser means for pivotal dressing movement along the full width of their respective grinding surfaces.

5. The dressing apparatus of claim 2 wherein said support means includes adjustment means for said wheel dresser means arranged to reset the dressing plane of at least one of the wheel dresser means.

6. The dressing apparatus of claim 2 wherein said support means includes adjustment means for said wheel dresser means arranged to reset the dressing planes of said pair of wheel dresser means relative to each other.

7. The dressing apparatus of claim 6 wherein said support means is slidably mounted on said base means for longitudinal movement in the direction at which the grinding wheel requires dressing, said adjustment means including a threaded adjusting screw for positioning said support means in proper positions of dressing by said wheel dresser means.

* * * * *